US009120206B1

(12) United States Patent
Lee

(10) Patent No.: US 9,120,206 B1
(45) Date of Patent: Sep. 1, 2015

(54) CAM-ACTIVATED BENCH VISE

(71) Applicant: John Yongki Lee, Springdale, UT (US)

(72) Inventor: John Yongki Lee, Springdale, UT (US)

( * ) Notice: Subject to any disclaimer, the term of this patent is extended or adjusted under 35 U.S.C. 154(b) by 0 days.

(21) Appl. No.: 14/716,680

(22) Filed: May 19, 2015

(51) Int. Cl.
*B25B 1/12* (2006.01)

(52) U.S. Cl.
CPC ..... *B25B 1/12* (2013.01)

(58) Field of Classification Search
CPC ..... B25B 1/08; B25B 1/10; B25B 1/02; B25B 1/20; B25B 5/04; B25B 5/08
See application file for complete search history.

(56) References Cited

U.S. PATENT DOCUMENTS

| | | | | |
|---|---|---|---|---|
| 3,578,308 | A * | 5/1971 | Jesionowski | 269/212 |
| 4,133,519 | A * | 1/1979 | Shin et al. | 269/247 |
| 4,569,510 | A * | 2/1986 | Haramoto | 269/181 |
| 7,036,807 | B1 * | 5/2006 | Gasparyan et al. | 269/181 |
| 2006/0108729 | A1 * | 5/2006 | Siegel | 269/266 |
| 2015/0137441 | A1 * | 5/2015 | Liang | 269/181 |

* cited by examiner

*Primary Examiner* — Lee D Wilson
(74) *Attorney, Agent, or Firm* — Gurr & Brande, PLLC; Robert A. Gurr

(57) ABSTRACT

In one embodiment a cam-activated bench vise comprises a fixed jaw having a first gripping surface, a moveable jaw having a second gripping surface, a threaded rod for providing movement of the moveable jaw relative to the fixed jaw, a hinged split nut for selectively engaging the threaded rod, and a lever actuated cam that rotates a beveled plunger against a first end of the split nut, forcing a second end of the split nut to engage a bevel-mouthed receiving block which causes the split nut to close and to engage the threaded rod.

6 Claims, 4 Drawing Sheets

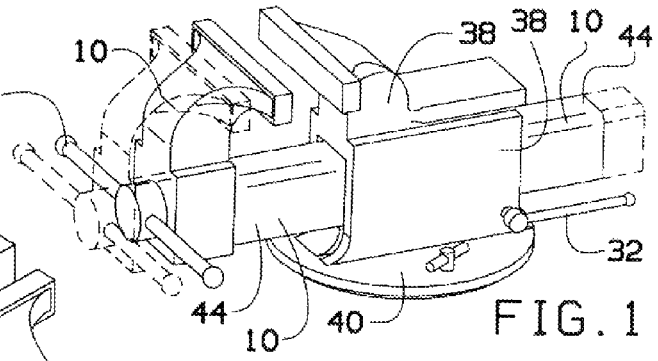
FIG. 1
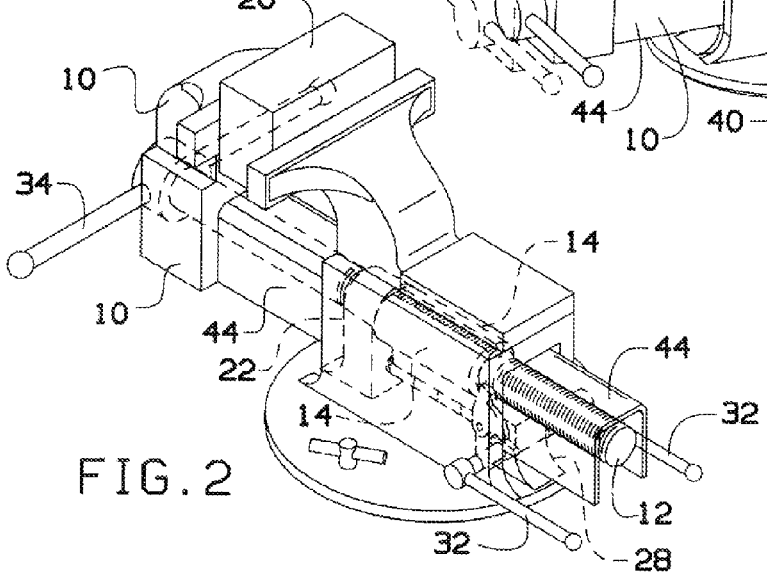
FIG. 2
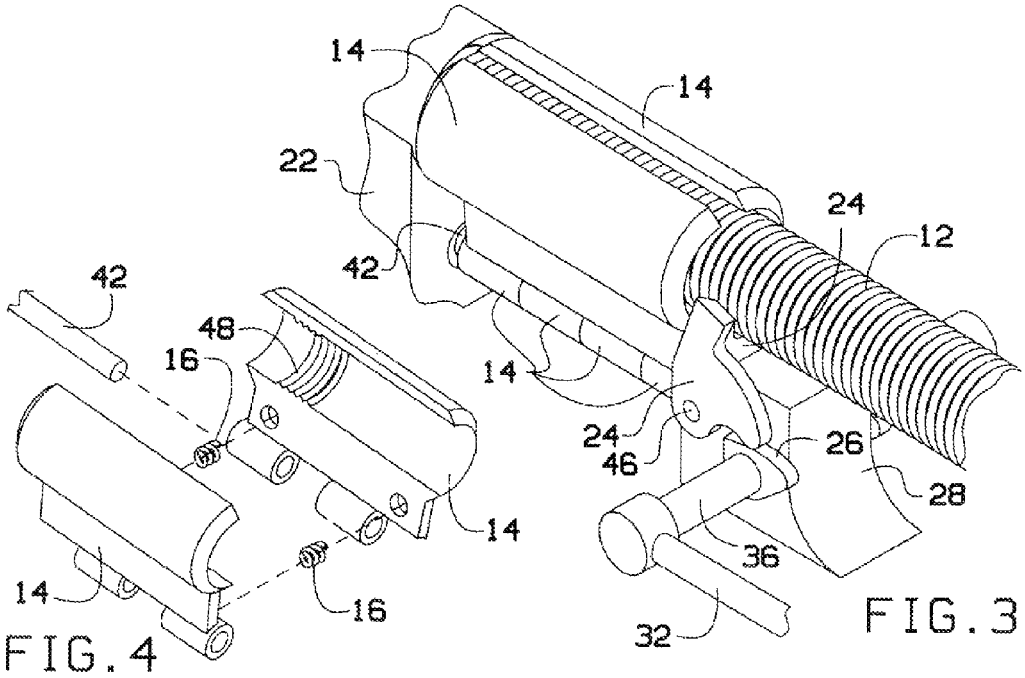
FIG. 4
FIG. 3

CAM-ACTIVATED BENCH VISE

CROSS-REFERENCE TO RELATED APPLICATIONS

Not applicable.

TECHNICAL FIELD

The present disclosure relates generally to bench vises. More particularly, the present disclosure relates to a cam-activated split nut bench vise.

BACKGROUND

Bench vises are known to be widely beneficial due to their ability to securely grip a workpiece. However, traditional vises require a user to actuate a screw (or "threaded rod") to tighten the grip on a workpiece. However, this may be a time-consuming process when the workpieces vary in size as a user would have to rotate the screw many times. To solve this, quick-release vises were invented and typically employ the use of a split nut that allows a screw to engage or disengage by actuating a handle or lever. However, the integrity of the nut is compromised, which creates weakness in the clamping mechanism. Further, many split nuts are threaded on only one side of the nut, which creates additional weakness in the clamping mechanism.

Therefore, there remains a need for a quick release vise that maintains threads on both sides of the nut and that does not create weakness when being split. The present invention seeks to solve these and other problems.

SUMMARY OF EXAMPLE EMBODIMENTS

It has been recognized that it would be advantageous to develop a table-mounted bench vise with a quick-release mechanism that does not compromise the gripping ability of the clamp.

In one embodiment a cam-activated bench vise comprises a fixed jaw having a first gripping surface, a moveable jaw having a second gripping surface, a threaded rod for providing movement of the moveable jaw relative to the fixed jaw, a hinged split nut for selectively engaging the threaded rod, and a lever actuated cam that rotates a beveled plunger against a first end of the split nut, forcing a second end of the split nut to engage a bevel-mouthed receiving block which causes the split nut to close and to engage the threaded rod.

In one embodiment, one or more springs are interposed between the two halves of the hinged split nut, allowing for easier disengagement of the split nut from the threaded rod when the cam is rotated, thereby releasing the beveled plunger from the split nut. Further, one or more springs may further be interposed between the split nut and the bevel-mouthed receiving block, which forces the split nut out of a bevel-mouthed receiving block for easier disengagement of the split nut from the threaded rod.

BRIEF DESCRIPTION OF THE DRAWINGS

FIG. 1 is a front perspective view of a cam-actuated split nut bench vise with the cam disengaged FIG. 2 is a rear perspective view of a cam-actuated split nut bench vise with the cam disengaged FIG. 3 is a detailed perspective view of the quick release mechanism FIG. 4 is an exploded view of the split nut

DETAILED DESCRIPTION OF EXAMPLE EMBODIMENT(S)

Figure 5:
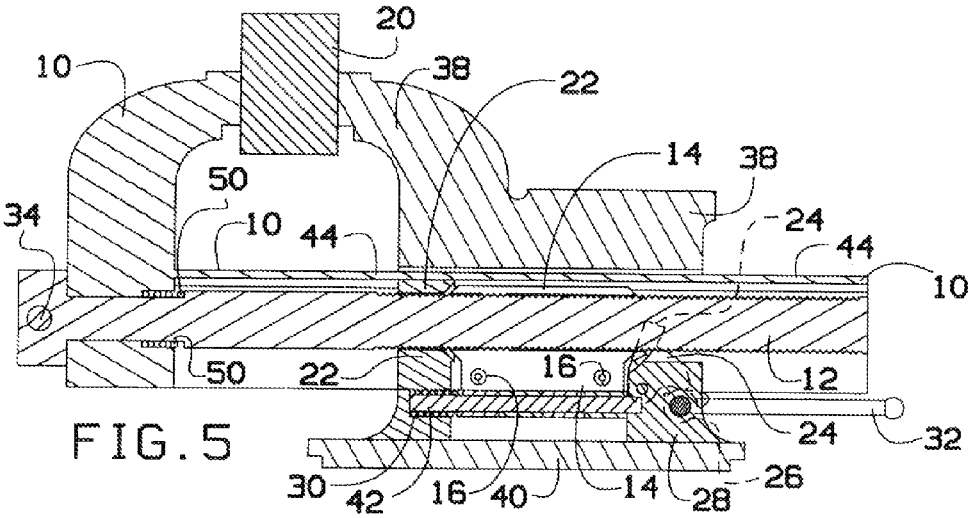
FIG. 5 is a cross-section side view of a cam-actuated split nut bench vise

The following descriptions depict only example embodiments and are not to be considered limiting of its scope. Any reference herein to "the invention" is not intended to restrict or limit the invention to exact features or steps of any one or more of the exemplary embodiments disclosed in the present specification. References to "one embodiment," "an embodiment," "various embodiments," and the like, may indicate that the embodiment(s) so described may include a particular feature, structure, or characteristic, but not every embodiment necessarily includes the particular feature, structure, or characteristic. Further, repeated use of the phrase "in one embodiment," or "in an embodiment," do not necessarily refer to the same embodiment, although they may.

Reference to any included drawings is done throughout the disclosure using various numbers. The numbers used are for the convenience of the drafter only and the absence of numbers in an apparent sequence should not be considered limiting and does not imply that additional parts of that particular embodiment exist. Numbering patterns from one embodiment to the other need not imply that each embodiment has similar parts, although it may.

Accordingly, the particular arrangements disclosed are meant to be illustrative only and not limiting as to the scope of the invention, which is to be given the full breadth of the appended claims and any and all equivalents thereof. Although specific terms are employed herein, they are used in a generic and descriptive sense only and not for purposes of limitation. Unless otherwise expressly defined herein, such terms are intended to be given their broad, ordinary, and customary meaning not inconsistent with that applicable in the relevant industry and without restriction to any specific embodiment hereinafter described. As used herein, the article "a" is intended to include one or more items. When used herein to join a list of items, the term "or" denotes at least one of the items, but does not exclude a plurality of items of the list. For exemplary methods or processes, the sequence and/or arrangement of steps described herein are illustrative and not restrictive.

It should be understood that the steps of any such processes or methods are not limited to being carried out in any particular sequence, arrangement, or with any particular graphics or interface. Indeed, the steps of the disclosed processes or methods generally may be carried out in various different sequences and arrangements while still falling within the scope of the present invention.

In one embodiment, as generally shown in FIGS. 1-4, a cam-activated bench vise comprises a fixed jaw 38 having a first gripping surface, a moveable jaw 10 having a second gripping surface, a threaded rod 12 for providing movement of the moveable jaw 10 relative to the fixed jaw 38, a hinged split nut 14 for selectively engaging the threaded rod 12, and a lever actuated cam 26 that rotates a beveled plunger 24 against the split nut 14 to engage the threaded rod 12. The cam-activated bench vise may further comprise a base 40, threaded rod housing 44, a clamping lever 34 for rotation of the threaded rod 12, and a cam lever 32. The threaded rod housing may pass through an aperture in the fixed jaw 38. A bevel-mouthed receiving block 22 is connected to the fixed jaw 38 and receives a second end of split nut 14 when cam 26 is actuated using cam lever 32 which forces the beveled plunger 24 proximal to and engaging with a first end of the split nut 14. As the split nut 14 is forced in a linear direction toward the bevel-mouthed receiving block 22, the second end of the split nut 14, which is complementary beveled, is forced into the bevel-mouthed receiving block 22, which thereby forces the split nut to close with its threads engaging the threaded rod 12. It will be appreciated that while the drawings use a beveled plunger 24, the plunger need not be beveled to accomplish the same result. Cam base 28 is at a first end of split nut 14 while bevel-mouthed receiving block 22 is at a second end, which thereby holds the split nut 14 in position for use using rod 42.

As seen in FIGS. 3-4, the split nut 14 may be hinged on a bottom end using rod 42 or equivalent, which allows the split nut 14 to open and close accordingly. Further, as shown in FIG. 4, one or more hinge springs 16 may be used to facilitate easier disengagement of threads 48 on the split nut 12 when the beveled plunger 24 is disengaged. It will be appreciated that while the images include lever connector 36, which allows for ease of rotation away from the threaded rod and housing, it need not be included.

Figure 6:
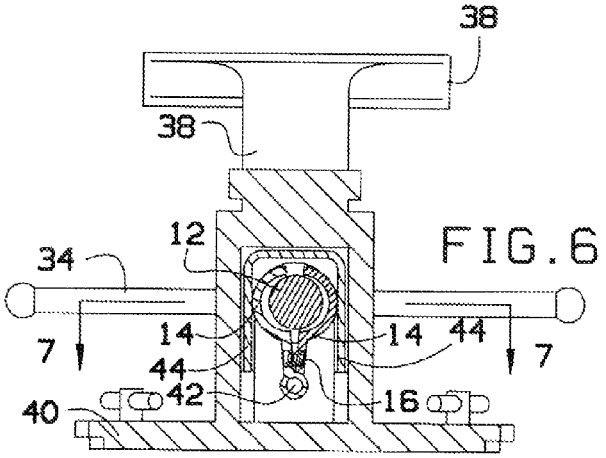
FIG. 6 is a cross-section front view of a cam-actuated split nut bench vise with the split nut disengaged
Figure 7:
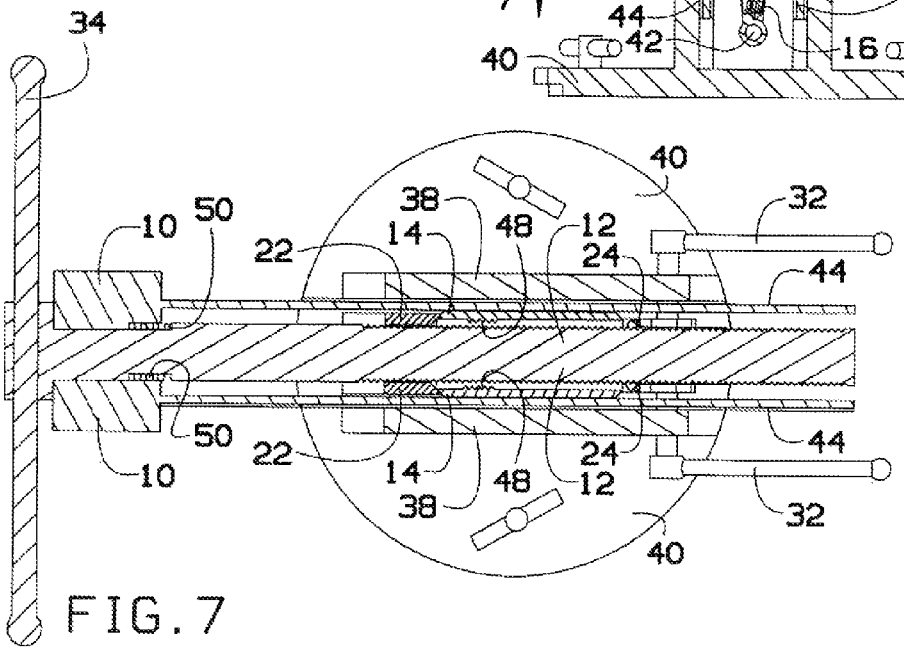
FIG. 7 is a top section view along lines 7-7 in FIG. 6

FIG. 5 illustrates a cross-sectional detailed view of a cam-activated bench vise. As shown, cam lever 32 is in the disengaged position. As such, the beveled plunger 24 is likewise disengaged from the split nut 14. Housing springs 30 are extended, which keep (or push out) the split nut 14 from entering the bevel-mouthed receiving block 22. When outside of the bevel-mouthed receiving block 22, hinge springs 16 force the split nut 14 in the open, or disengaged, position, as can be more fully seen in FIG. 6. FIG. 7 illustrates how the threads 48 of the split nut 14 are disengaged from the threaded rod 12 when the split nut 14 is in the open, or disengaged, position. It will be appreciated by those in the art that although the threads 48 are only shown on a small portion of the split nut 14, the threads 48 may range from the entirety of the inside of split nut 14 to a minimal amount that still provides for sufficient engagement such that the threaded rod 12 cannot slip free. Rod springs 50 may also be included, which allow the moveable jaw 10 and the fixed jaw 38 to maintain improved tension on the workpiece 20.

Figure 8:
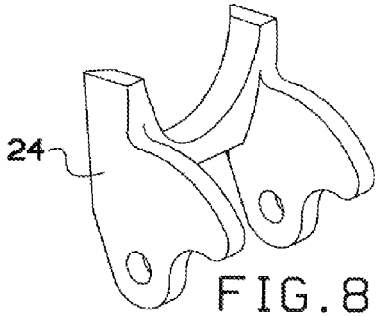
FIG. 8 is a perspective view of a beveled plunger

FIG. 8 is a perspective view of a beveled plunger 24. As shown, the beveled plunger 24 is able to exert force on both sides of the split nut 14.

Figure 9:
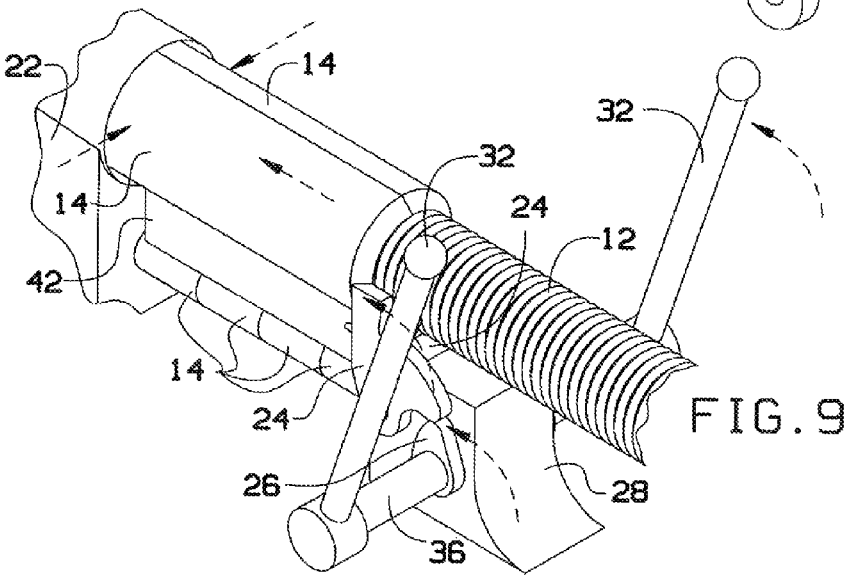
FIG. 9 is a perspective view with the cam actuated and the split nut engaging the threaded rod
Figure 10:
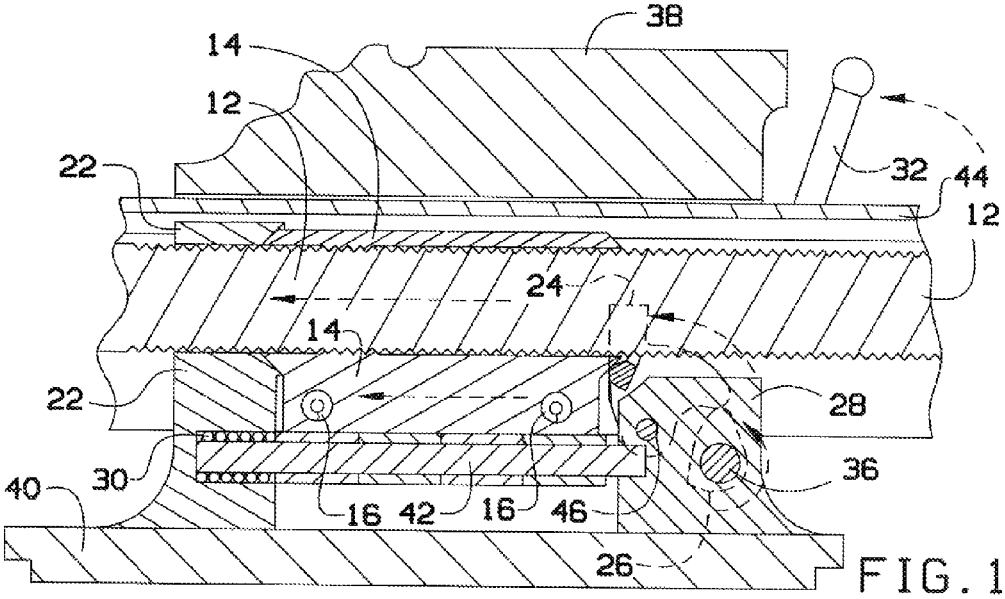
FIG. 10 is a side detailed cross section with the cam actuated and the split nut engaging the threaded rod
Figure 11:
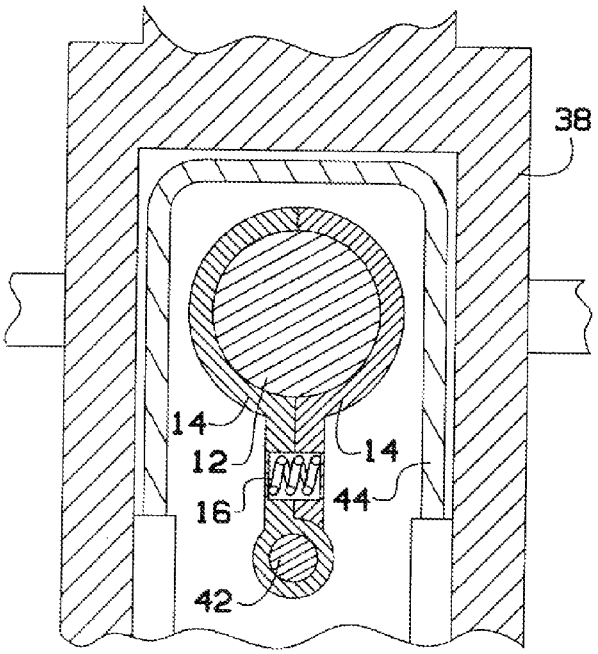
FIG. 11 is a front detailed cross section with the split nut received in the bevel-mouthed receiving block and engaging the threaded rod
Figure 12:
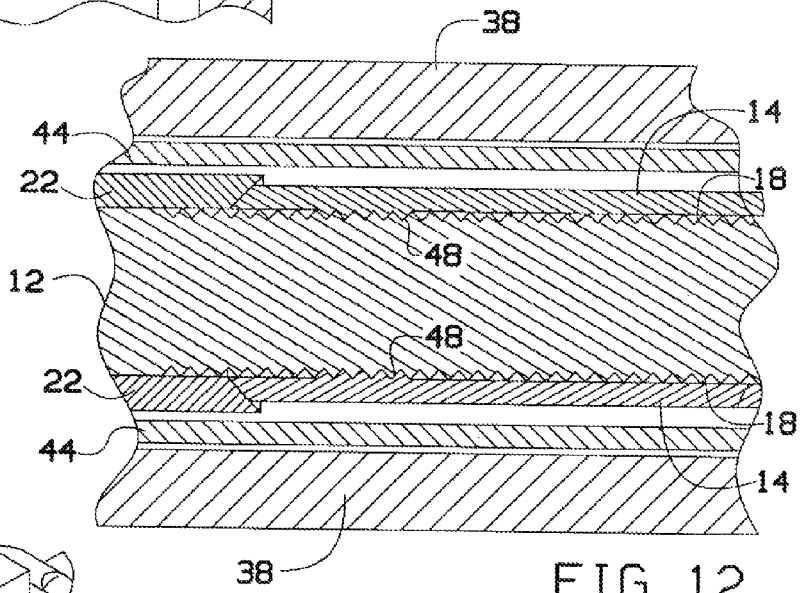
FIG. 12 is a top detailed cross section with the split nut received in the bevel-mouthed receiving block and engaging the threaded rod
Figure 13:
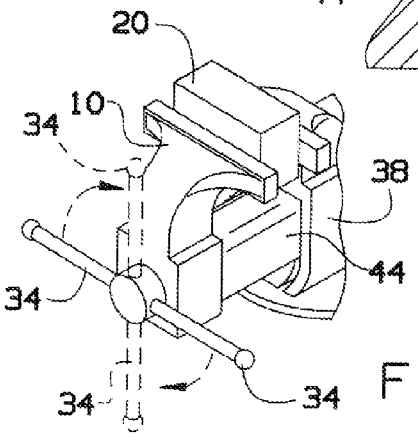
FIG. 13 is a front perspective view demonstrating rotation of the clamping lever

FIG. 9 illustrates the cam lever 32 in a raised, or actuated, position. As shown cam 26 rotates and engages beveled plunger 24, causing the plunger to rotate and force split nut 14 in a linear direction toward bevel-mouthed receiving block 22 for engagement therein. As the second end of the beveled split nut 14 enters the bevel-mouthed receiving block 22, the split nut 14 is forced to close and thereby engage the threaded rod 12. As best seen in FIGS. 11-13, once the split nut 14 is engaged with the threaded rod 12 via threads 48, a user may then rotate clamping lever 34, which causes the threaded rod 12 to rotate accordingly and thereby exert a clamping force on a workpiece 20. In other words, in one method of use, a user may place a workpiece 20 between the fixed jaw 38 and the moveable jaw 10, slide the moveable jaw 10 proximal to and engaging with the workpiece 20, which is proximal to and engaged with the fixed jaw 38, actuate the cam lever 32, which rotates a cam 26 and which thereby rotates the beveled plunger 24 proximal to and engaging with a first end of the split nut 14, force the cam lever 32 such that the split nut 14 is received by the bevel-mouthed receiving block 22, causing the split nut 14 to close and engage the threaded rod 12, and then rotate the clamping lever 34 until the desired amount of force is applied to the workpiece 20.

When a user desires to disengage the clamp from a workpiece 20, the user may disengage the threads 48 of the split nut 14 from the threaded rod 12 by rotating the cam lever 32 which thereby disengages the beveled plunger from a first end of the split nut 14. Once disengaged, the clamp lever 34 may be rotated in a loosening direction which then allows housing springs 30 to assist in forcing the split nut 14 from within the bevel-mouthed receiving block 22. Once disengaged from the bevel-mouthed receiving block 22, one or more hinge springs 16 force the split nut 14 into an open, or disengaged, position, allowing a user to easily slide the moveable jaw 10 away from the workpiece 20, thereby easily releasing it and resizing the clamping area as needed.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. A cam-activated bench vise, comprising:
- a fixed jaw having a first gripping surface;
- a moveable jaw having a second gripping surface;
- a threaded rod for providing movement of the moveable jaw relative to the fixed jaw;
- a hinged split nut for selectively engaging the threaded rod;
- a lever actuated cam that rotates a plunger proximal to a first end of a split nut; and
- wherein the split nut has a beveled second end for engagement with a bevel-mouthed receiving block.

2. The cam-activated bench vise of claim 1, further comprising a base, a threaded rod housing, and a clamping lever for rotation of the threaded rod.

3. The cam-activated bench vise of claim 1, wherein the hinged split nut comprises hinge springs.

4. The cam-activated bench vise of claim 1, wherein the bevel-mouthed receiving block comprises housing springs positioned to engage a second end of the split nut.

5. A cam-activated bench vise, comprising:
- a fixed jaw having a first gripping surface and an aperture for receiving
- a threaded rod housing;
- a moveable jaw having a second gripping surface;
- wherein the threaded rod housing comprises a threaded rod for
- providing movement of the moveable jaw relative to the fixed jaw;
- a hinged split nut for selectively engaging the threaded rod;
- a lever actuated cam that rotates a plunger proximal to a first end of a hinged split nut;

wherein the hinged split nut has one or more hinge springs and has a beveled second end for engagement with a bevel-mouthed receiving block; and a clamping lever for rotating the threaded rod.

6. A method of using the cam-activated bench vise of claim 5, comprising:

placing a workpiece between the fixed jaw and the moveable jaw;

sliding the moveable jaw proximal to and engaging with the workpiece, which is proximal to and engaged with the fixed jaw;

actuating the cam lever, which rotates a plunger proximal to and engaging with a first end of the split nut;

forcing the cam lever such that the split nut is received by the bevel-mouthed receiving block, causing the split nut to close and engage the threaded rod; and rotating the clamping lever until the desired amount of force is applied to the workpiece.

* * * * *